US005209537A

United States Patent [19]

Smith et al.

[11] Patent Number: 5,209,537

[45] Date of Patent: May 11, 1993

[54] GRIPPING APPARATUS FOR OMNIFARIOUS CONTAINERS

[75] Inventors: Fred P. Smith; Fred T. Smith, both of Alpine; Kevin L. McAllister, Orem, all of Utah

[73] Assignee: The Heil Co., Chattanooga, Tenn.

[21] Appl. No.: 728,186

[22] Filed: Jul. 10, 1991

[51] Int. Cl.[5] ..... B65F 3/04; B66C 1/44

[52] U.S. Cl. ..... 294/111; 294/88; 294/106; 414/408

[58] Field of Search ..... 294/86.4, 88, 106, 111, 294/112, 902; 414/303, 406–409, 555, 620, 621, 626

[56] References Cited

U.S. PATENT DOCUMENTS

| | | | |
|---|---|---|---|
| 3,322,455 | 5/1967 | Gressbach | 294/86.4 X |
| 3,850,469 | 11/1974 | Vit | 294/88 |
| 3,927,424 | 12/1975 | Itoh | 294/106 X |
| 3,970,342 | 7/1976 | Cotton | 294/86.4 |
| 4,023,848 | 5/1977 | Bennett | 294/106 X |
| 4,068,881 | 1/1978 | Dressler et al. | 294/111 |
| 4,084,706 | 4/1978 | Russell | 294/111 X |
| 4,383,789 | 5/1983 | Takamatsu | 294/111 X |
| 4,401,407 | 8/1983 | Breckenridge | 294/88 X |
| 4,435,117 | 3/1984 | House | 414/620 |
| 4,669,940 | 6/1987 | Englehardt et al. | 294/106 X |
| 4,708,570 | 11/1987 | Smith et al. | 294/106 X |
| 5,020,844 | 6/1991 | Pickrell | 294/86.4 |
| 5,066,189 | 11/1991 | Shell | 294/111 X |
| 5,092,731 | 3/1992 | Jones et al. | 294/106 X |

FOREIGN PATENT DOCUMENTS

| | | | |
|---|---|---|---|
| 121104 | 9/1971 | Denmark | 294/88 |
| 394281 | 11/1973 | U.S.S.R. | 294/111 |
| 604793 | 4/1978 | U.S.S.R. | 294/112 |
| 751794 | 7/1980 | U.S.S.R. | 294/86.4 |
| 1025646 | 6/1983 | U.S.S.R. | 294/111 |
| 1211203 | 2/1986 | U.S.S.R. | 294/111 |

*Primary Examiner*—Johnny D. Cherry

*Attorney, Agent, or Firm*—Don J. Flickinger; Jordan M. Meschkow; Robert A. Parson

[57] ABSTRACT

A pair of elongate, segmented gripping members are carried by the lifting member of a refuse collection vehicle. Each of the gripping members includes an inner arm movably carried by the lifting member and an outer arm movably extending from the inner arm. The gripping members are movable between a retracted position in which the inner arms extend in generally opposite directions, fore and aft along the side of the vehicle, and an extended position in which the inner arms extend in generally the same direction laterally outward from the vehicle. Each outer arm is inwardly movable relative to the respective inner arm to draw a container into the embrace of the gripping members. A pair of elongate flexible members engage the container to supplement the grip of the gripping members.

1 Claim, 7 Drawing Sheets

GRIPPING APPARATUS FOR OMNIFARIOUS CONTAINERS

BACKGROUND OF THE INVENTION

1. Field of the Invention

This invention relates to gripping devices.

More particularly, the present invention relates to gripping apparatus of the general type having a pair of opposed gripping members and typically fitted to a refuse collection vehicle.

In a further and more specific aspect, the instant invention concerns an improved gripping apparatus especially adapted for alternately engaging and holding multifarious refuse containers.

2. Prior Art

The collection and disposition of refuse, common commercial and domestic waste and trash colloquially referred to as garbage, has become highly sophisticated, mechanized and automated. Initially, the refuse is deposited and temporarily stored in a conveniently located container. Subsequently, the contents of the container are received by a refuse collection vehicle for ultimate transfer to a disposal site. The vehicle, usually operating on a regular periodic schedule, is generally capable of accommodating numerous containers.

Refuse containers for the instant purpose are readily commercially available in an array of types, sizes and configurations. Common, for example, are stationary containers and portable containers, large containers and small containers, and round containers and square containers. Large round containers, usually permanently positioned at a central location for multiple users, have a capacity ranging to four hundred gallons and a diameter as large as forty-eight inches. Having capacities beginning at approximately thirty gallons and diameters of fifteen inches, small round containers are frequently fitted with wheels for mobility. Square containers, with a transverse measurement in the range of fourteen inches to twenty-nine inches, have a nominal capacity of forty to ninety gallons.

The foregoing measurements and geometric configurations are taken in cross-section at the gripping surface or perimeter which resides approximately twenty-eight inches above the supporting surface. In actuality, each container is defined by a continuous, upright sidewall having a taper in the general range of four to seven degrees which accommodates mold release and stacking. Preferably fabricated of polyethylene by various conventional molding processes, the typical container is characterized by a relatively flexible sidewall having a substantially smooth exterior surface.

The conventional refuse collection vehicle basically includes a cab, a body and a container handling mechanism carried upon a wheeled chassis. The container handling mechanism is controllably actuated in response to an on-board source of pressurized hydraulic fluid selectively directed by controls located at the operator's compartment within the cab. The body is generally bipartite, having a hopper and a stowage bin for respectively receiving and stowing refuse. Refuse handling means, usually termed a packer, transfers and compacts refuse from the hopper to the stowage bin.

Typically, the container handling mechanism includes a pair of opposed gripping members carried at the end of a lifting member or boom which is extendable and retractable relative the curb or pick-up side of the vehicle. During travel of the vehicle, the container handling mechanism resides in a retracted position with the gripping members extending in opposite directions, fore and aft, along the side of the vehicle. After the vehicle is brought to a stop, the boom is extended and the gripping members engaged about the container. The boom is then elevated to position the container atilt over the hopper for deposit of the refuse. Successively, the boom is lowered, the container released and the container handling mechanism retracted for stowage during subsequent movement of the vehicle.

The interaction between the container and the container handling mechanism is rife with inherent problems. Initially noted is the engagement of the gripping members which is primarily dependent upon the forces of constriction and friction to lift, tilt and maneuver the container. Insufficient force will result in the container slipping from the grasp of the gripping members, especially during tilting with a resultant fall into the hopper. Conversely, a container is easily subjected to destructive distortion by excessive or improperly applied force.

Another source of considerable concern is the fact that a random, homogeneous mix of containers are frequently utilized within a given geographic area. Conventional prior art gripping members are generally limited to engaging and holding a specifically designated container. Accordingly, the area must be traversed by more than one collection vehicle, or alternately, by a single vehicle on successive trips following alteration of the gripping apparatus.

Various other sources of perturbation are also evident. For example, initial overextension of the boom can tip or push the container beyond reach of the gripping members. Correction is laborious and wasteful. Further noteworthy is the retracted position of container handling apparatus. The exceedingly long gripping members, extending fore and aft, must either reside precariously outboard of the wheels, beyond the legal envelope width, or require a vehicle of considerable wheelbase.

The prior art has proposed various purported solutions to the foregoing problems. However, none has proven to be entirely satisfactory. It would be highly desirable, therefore, to remedy the foregoing and other deficiencies inherent in the prior art.

Accordingly, it is an object of the present invention to provide an improved gripping apparatus of the type normally used in connection with a refuse collection vehicle.

Another object of the invention is the provision of an improved gripping apparatus especially adapted for engaging and holding refuse containers of diverse cross-sectional configuration and measurement.

And another object of this invention is to provide a gripping apparatus which, without modification or alteration, can alternately grip a variety of containers.

Still another object of the invention is the provision of means for securely gripping a wide variety of containers with minimal distortion.

Yet another object of this instant invention is to provide a gripping apparatus having improved means for relatively uniformly distributing the gripping load about the perimeter of a container.

Yet still another object of the invention is the provision of an improved gripping apparatus for applying a generally circumferential compressive gripping force to a refuse container.

A further object of the invention is to provide a gripping apparatus having novel means for extending about and pulling a container into an ameliorated gripping position.

And a further object of the immediate invention is the provision of a gripping apparatus which is more compactly stowable, thereby allowing for a collection vehicle of substantially shortened wheelbase.

Still a further object of the invention is to provide an improved gripping apparatus which can be readily and conveniently retrofitted to a conventional prior art refuse collection vehicle.

And still a further object of the invention is the provision of improvements according to the foregoing which are expediently practiced, fabricated and maintained, in accordance with standard techniques of the art.

SUMMARY OF THE INVENTION

Briefly, to achieve the desired objects of the invention in accordance with a preferred embodiment thereof, first provided are first and second segmented gripping members, each having an inner arm movably affixed to the lifting member of a refuse collection vehicle and an outer arm movably extending from the inner arm. Next provided are actuating means carried by the lifting member for moving the gripping member between a retracted position and an extended position. In the retracted position, the inner arms extend in substantially opposed directions. In the extended position, the inner arms extend in substantially the same direction. Further provided are tensioning means for moving each outer arm inwardly relative the respective inner arm.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings in which.

DESCRIPTION OF THE PREFERRED EMBODIMENT

Figure 1:
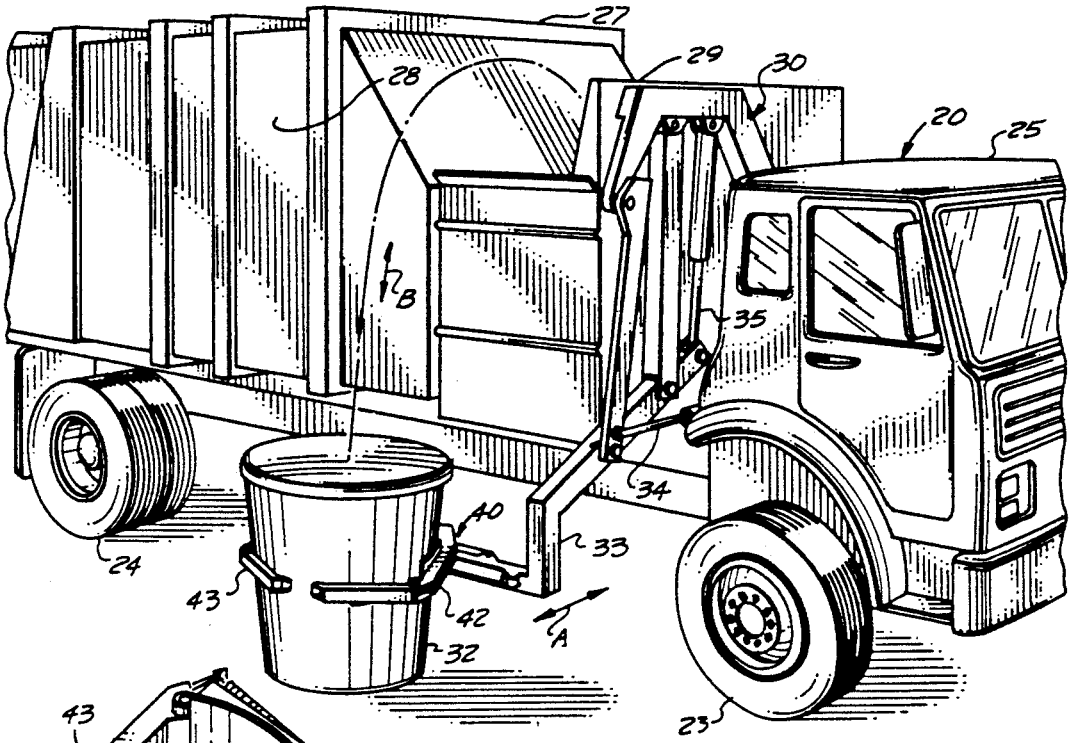
FIG. 1 is a partial perspective view of a refuse collection vehicle fitted with a gripping apparatus embodying the principles of the instant invention, the gripping apparatus being illustrated as it would appear when engaged about a refuse container.

Turning now to the drawings, in which like reference characters indicate corresponding elements throughout the several views, attention is first directed to FIG. 1 which illustrates a conventional prior art refuse collection vehicle generally designated by the reference character 20. Herein viewed from the curb side, vehicle 20 includes frame 22 supported and mobilized by a plurality of wheels including front wheels 23 and rear wheels 24 having complimentary mirror images on the opposite or street side of vehicle 20.

Cab 25 and body 27 are carried at spaced apart locations upon chassis 22. Cab 25, enclosing an operators compartment, resides proximate the forward end of chassis 22. Body 27, located upon the rearward portion of chassis 22, includes storage bay 28 and hopper 29. Although not specifically illustrated but as will be appreciated by those skilled in the art, hopper 29 located forwardly of storage bay 28, includes means for compacting and stowing refuse within storage bay 28.

A container handling mechanism, generally designated by the reference character 30, for lifting refuse container 32 and dumping the contents thereof into hopper 29 is carried upon the chassis 22, intermediate cab 25 and body 27. For purposes of exemplification, container handling mechanism 30 is illustrated as having a lifting member or boom 33 which is reciprocally movable in lateral directions, as indicated by the double arrowed line A, between an extended position as shown and a retracted position. Boom 33 is also angularly movable through an upright arc, as indicated by the double arrowed line B, between a lowered position as shown and an elevated position in which container 32 is atilt and substantially above hopper 29.

Double acting hydraulic cylinder assembly 34 urges lateral movement of boom 33. Angular movement is effected by hydraulic cylinder assembly 35. Pressurized hydraulic fluid for selective actuation of the cylinder assemblies is supplied by an on-board source in response to controls located at the operators station within cab 25. Neither the source of pressurized hydraulic fluid nor the controls are specifically illustrated.

Set forth for purposes of orientation and reference in connection with the ensuing detailed description of the preferred embodiment of the instant invention, the foregoing brief description of refuse collection vehicle 20 is intended to be generally representative of typical, prior art, commercially available vehicles of the type. Details not specifically illustrated and described will be readily understood and appreciated by those skilled in the art.

With continued reference to FIG. 1, there is seen a gripping apparatus, generally designated by the reference character 40, embodying the teachings of the instant invention. Preferably carried by the outboard terminal portion of boom 33, gripping apparatus 40 includes a pair of opposed gripping members, first gripping member 42 and second gripping member 43. Specifically shown in the gripping position with gripping members 42 and 43 engaged about container 32, gripping apparatus 40 is selectively actuated in response to the previously described pressurized hydraulic fluid and operator controls.

Figure 2:
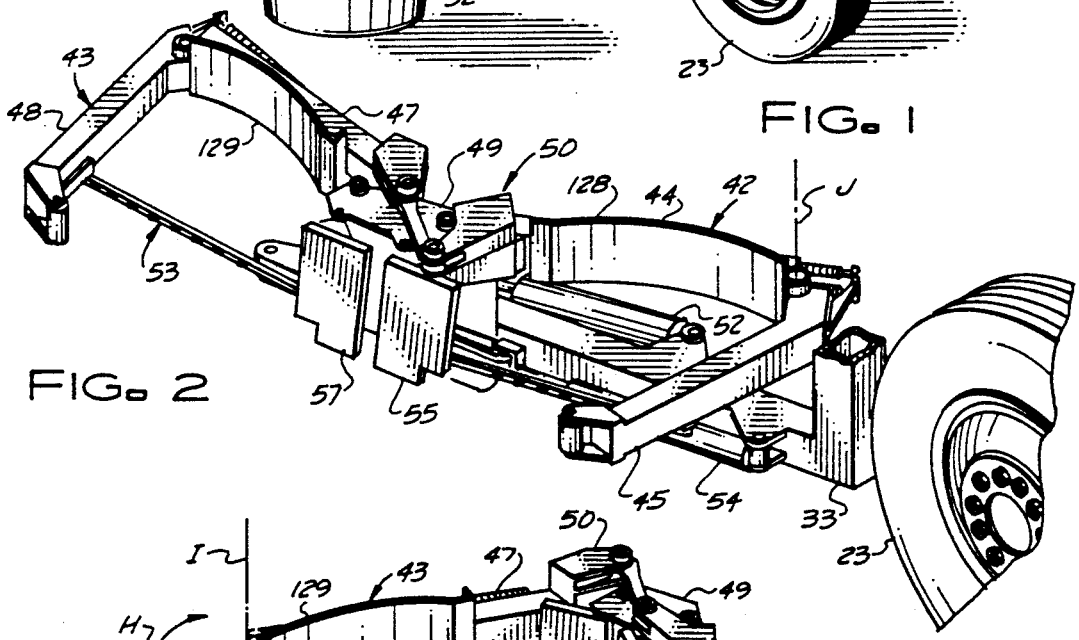
FIG. 2 is an enlarged perspective view of the gripping apparatus of FIG. 1 as it would appear in the retracted position.
Figure 3:
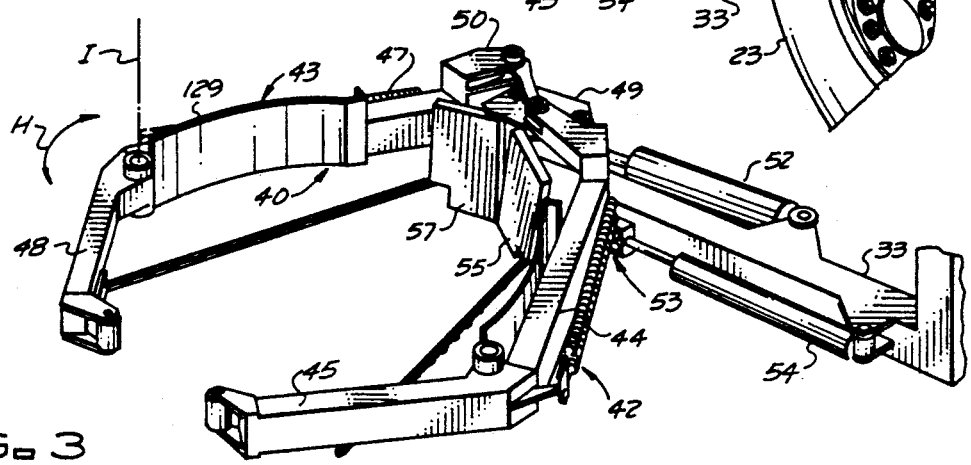
FIG. 3 is a view generally corresponding to the view of FIG. 2 and showing the gripping apparatus thereof in the extended position.

Referring now to FIGS. 2 and 3, it is seen that each gripping member is segmental. Briefly, first gripping member 42 includes inner arm 44 and pivotally connected outer arm 45. Second gripping member 43 similarly includes inner arm 47 and pivotally attached outer arm 48. The pivotal connection between each inner arm and the respective outer arm is rotatable about a substantially vertical axis.

Pedestal 49, carried by boom 33, pivotally supports the inner end of each gripping member for rotation about a substantially vertical axis. Actuating means, generally designated by the reference character 50 and including hydraulic cylinder 52, rotates gripping members 42 and 43 pedestal 49. More specifically, actuating means 50 relative to pedestal 49. More specifically, actuating means 50 moves the inner arms between the retracted position and the extended position. Tensioning means, generally designated by the reference character 53 and functioning in response to hydraulic cylinder 54, moves each outer arm relative to the respective inner arm and assists gripping members 42 and 43 in grasping and holding a refuse container. Pads 55 and 57, carried by pedestal 49, receive the container thereagainst. Further description of the foregoing elements will be made presently.

During travel of vehicle 20, gripping apparatus 40 is normally stowed in the retracted position as specifically illustrated in FIG. 2. Inner arms 44 and 47 extend fore and aft, respectively, and inboard from pedestal 49. Outer arms 45 and 48 extend convergently outboard from the respective inner arms. With boom 33 in the retracted position, gripping apparatus 40 preferably lies inboard of a plane defined by wheels 23 and 24. For engaging a container, first gripping member 42 and second gripping member 43 are extended in response to the operative cooperation of actuating means 50 and tensioning means 53 to a position as generally seen in FIG. 3.

Figure 4:
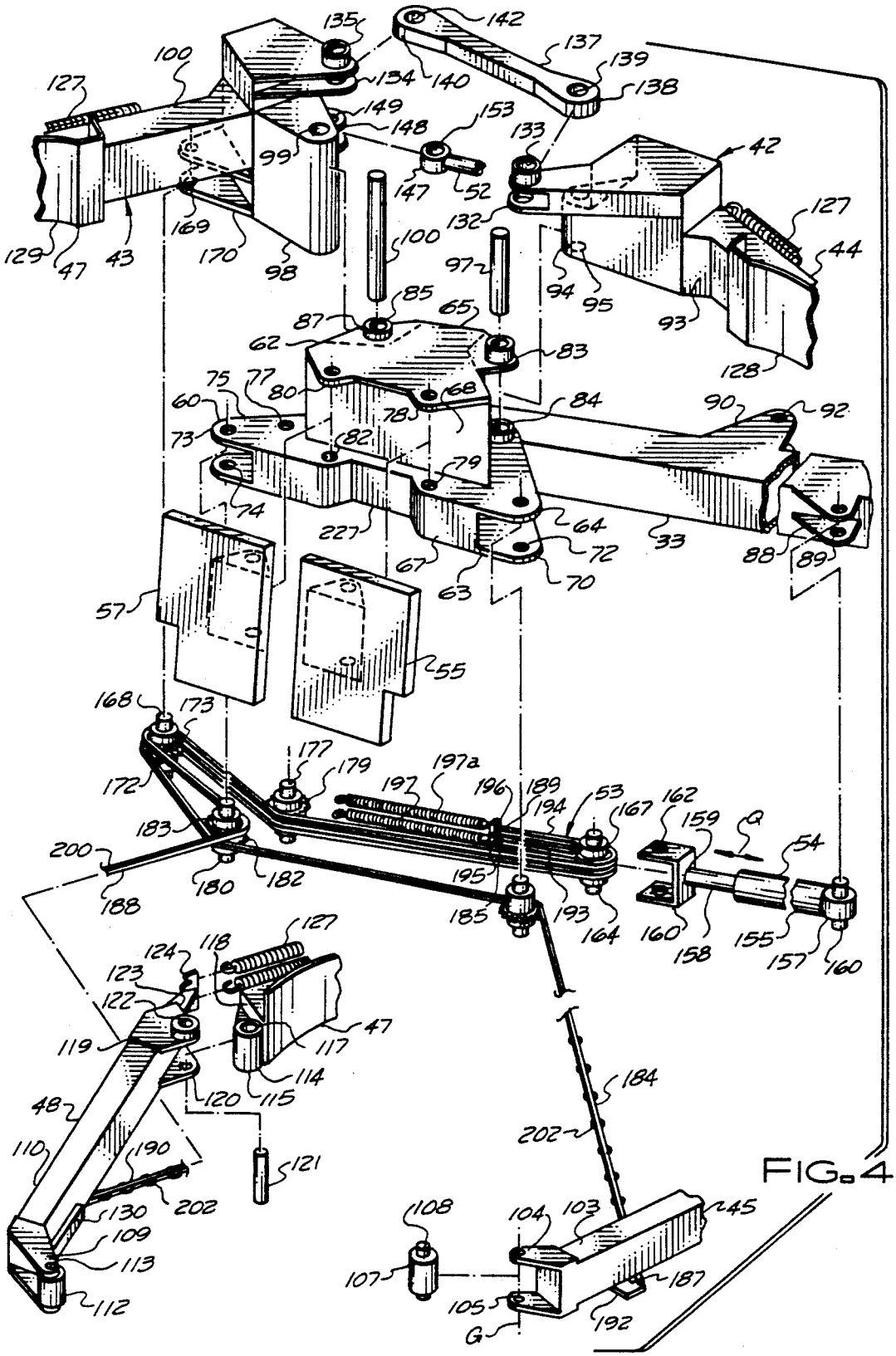
FIG. 4 is an exploded perspective view of the gripping apparatus of the instant invention, portions thereof being broken away for purposes of illustration.

Pedestal 49, more clearly viewed with reference to FIG. 4, includes foundation 60 supporting superstructure 62. Herein chosen for purposes of illustration and ease of manufacture, pedestal 49 is fabricated of three substantially horizontal plates; lower plate 63, intermediate plate 64 and upper plate 65. Spacer 67 holds lower plate 63 and intermediate plate 64 in spaced apart parallel relationship to provide foundation 60. Superstructure 62 includes upper plate 65 held in spaced apart parallel relationship to intermediate plate 64 by riser 68. Other methods of manufacturing pedestal 49, such as machining from solid, molding, casting and forging will readily occur to those skilled in the art.

Foundation 60, projecting generally outboard of boom 33, terminates with forwardly directed bifurcated mounting bracket 70 having bore 72 extending therethrough and with rearwardly directed bifurcated mounting bracket 73 including bore 74. A third, generally rearwardly inwardly directed bifurcated mounting bracket 75 having bore 77 is also carried by foundation 60.

Foundation 60 and superstructure 62, more specifically intermediate plate 64 and upper plate 65, cooperate to form a pair of outwardly directed bifurcated mounting brackets, forward bracket 78 having bore 79 and rearward bracket 80 having bore 82. Similarly, inwardly forwardly directed bifurcated mounting bracket 83 having bore 84 is formed by intermediate plate 64 and upper plate 65. Bifurcated mounting bracket 85, having bore 87 and formed by lower plate 63 and upper plate 64, extends rearwardly inward from pedestal 49. Bifurcated mounting bracket 88 having bore 89 projects outwardly from boom 33 at a location spaced forwardly of pedestal 49. Bifurcated mounting bracket 90 having bore 92 projects inboard from boom 33 at a location spaced forwardly from pedestal 49. Each of the bores associated with the several bifurcated mounting brackets carried by pedestal 49 and boom 33 extend along parallel substantially vertical axes.

Inner end 93 of first gripping member 42, coincidentally the inner end of inner arm 44, terminates with lug 94 having bore 95 therethrough. Lug 94 is sized and shaped to be received within bifurcated bracket 83. Pin 97 passing through bores 84 and 95 pivotally secures first gripping member 42 to pedestal 49 for rotation about the axis represented by the broken line C in directions indicated by the double arrowed arcuate line D as seen with further reference to FIG. 5. Lug 98 having through bore 99, carried at the inner end 100 of second gripping member 43, is received within bifurcated bracket 85 and secured thereto for pivotal movement as represented by the double arrowed arcuate line E about the axis represented by the broken line F. It is noted that the axes represented by the broken lines C and F are substantially spaced for purposes which will be presently described in further detail.

Referring more specifically to FIG. 4, it is seen that outer end 103 of first gripping member 42, coincidentally the outer end of outer arm 45, is bifurcated to form mounting bracket 104. Bore 105 extends through bracket 104 along an axis represented by the broken line G which is substantially parallel to the previously described axes C and F. Roller 107 is rotatably supported within bracket 104 by pin 108 which passes through bore 105. Similarly, bifurcated bracket 109 carried at the outer end 110 of second gripping member 43 rotatably supports cylindrical member 112 by means of pin 113. Each bracket 104 and 109 is turned angularly inward.

Outer end 114 of inner arm 47 of second gripping member 43 terminates with lug 115 having bore 117 therethrough and abutment surface 118. Inner end 119 of outer arm 48 terminates with bifurcated bracket 120 having bore 122 therethrough and complimentary abutment surface 123. Lug 115 is received within bracket 120 and affixed thereto by pin 121 concurrently extending through bores 117 and 122. Accordingly, outer arm 48 is pivotally affixed to inner arm 47 for relative rotational movement as represented by the double arrowed line H seen in FIG. 3. The movement proceeds about an axis represented by the broken line I which is parallel to the previously described axes C, F and G. Although not specifically illustrated, the outer and inner arms of first gripping member 42 are similarly joined for relative rotation about an axis represented by the broken line J in FIG. 2.

Figure 5:
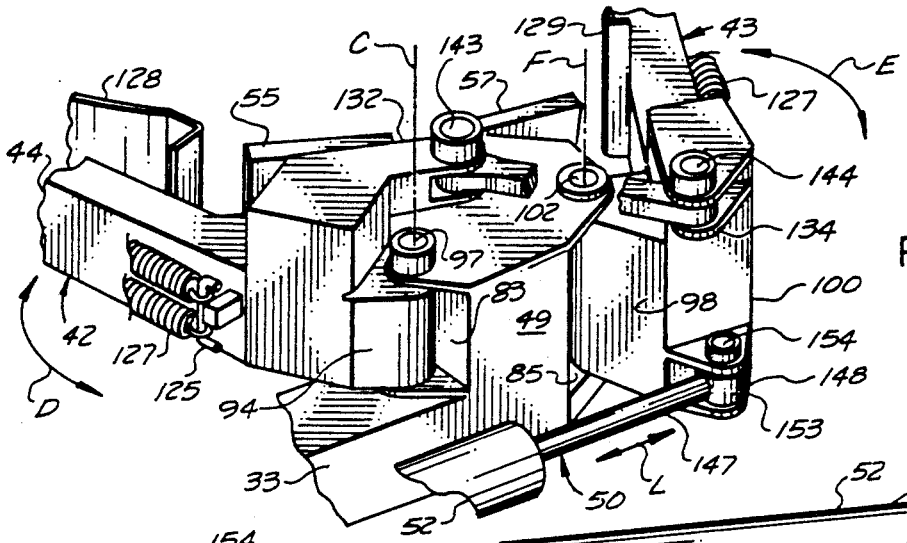
FIG. 5 is a fragmentary perspective view of the central portion of the gripping apparatus as seen in FIG. 3, the view being taken from the rear and on an enlarged scale.

An attachment bracket 124 is cantilevered to extend outwardly rearwardly from the inner end 119 of outer arm 48 as specifically seen in FIG. 4. A complimentary attachment bracket 125, best seen with reference to FIG. 5, is carried on the outboard side of inner arm 44 proximate the inner end 93 thereof. Although not specifically illustrated, it is understood that a mirror image of attachment bracket 124 is carried by outer arm 45. Similarly, a mirror image of bracket 125 is carried by inner arm 47. Tension springs 127 extend between the bracket 124 and the respective complimentary bracket 125 of each gripping member 142 and 143. Accordingly, each outer arm 45 and 48 is normally biased outwardly relative to the respective inner arm 44 and 47. The limit of movement, which is rotational about the axis I, is the contact of abutment surface 118 against the respective complemental abutment surface 123.

In accordance with the immediately preferred embodiment of the instance invention, the respective arms of each gripping member, inner arm 44 and outer arm 45 of first gripping member 42 and inner arm 47 and outer arm 48 of second gripping member 43, are straight. Concave panels 128 and 129 are carried on the inner side of inner arms 44 and 47, respectively. Preferably, each panel is an upright cylindrical section. A resilient pad 130 is carried on the inner side of each outer arm 45 and 48 proximate the respective outer end. Similarly, a generally concave configuration is imparted to each outer arm 45 and 48. The bifurcated outer end 104 of outer arm 45 and the bifurcated outer end 109 of outer arm 48 are inturned. Similarly, the bracket 120 carried at the inner end of each of the outer arms is inturned. Further discussion of the generally concave configuration of the inner surface of each of the arms will be made presently.

Figure 6:
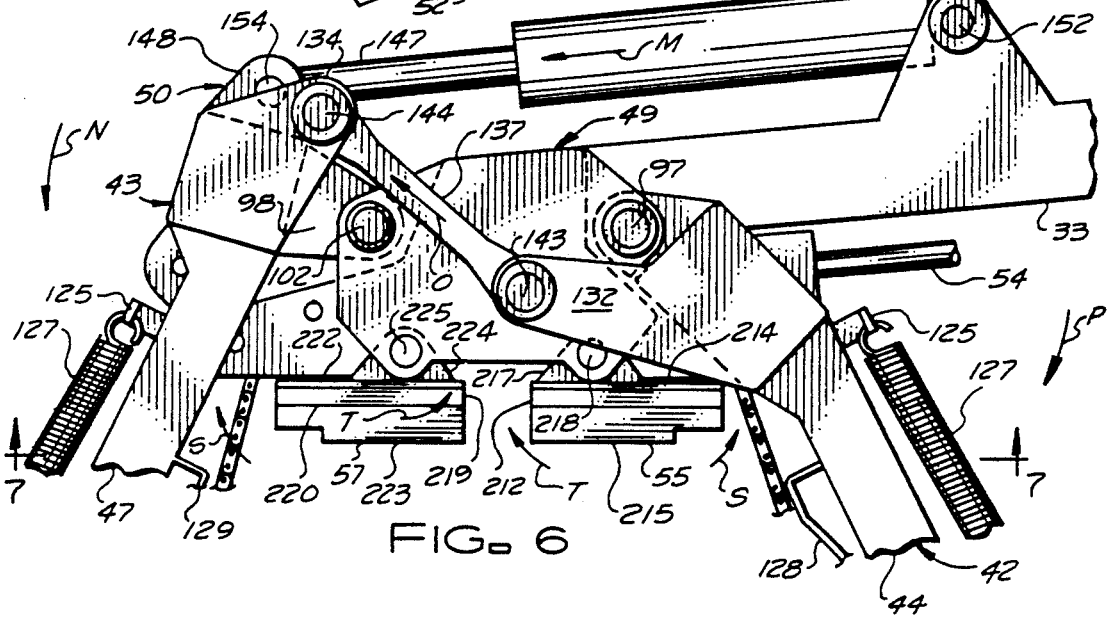
FIG. 6 is a top plan view generally corresponding to the view of FIG. 4.

Actuating means 50 will now be described in detail with particular reference to FIGS. 4, 5, and 6. Bifurcated bracket 132 having bore 133 extending therethrough extends generally inwardly rearward from the inner end 93 of inner arm 44 of first gripping member 42. Bifurcated bracket 134 extends generally rearward from the inner end 98 of inner arm 47 of second gripping member 43. Link 137 couples the inner ends 93 and 98 of first gripping member 42 and second gripping member 43, respectively. First end 138 of link 137 having bore 139 therethrough is received within bracket 132. Second end 140 having through bore 142 is received within bracket 134. Pin 143, extending through bores 133 and 139, pivotally secures first end 138 of link 137 within bracket 132. Similarly, second end 140 of link 137 is pivotally secured within bracket 134 by pin 144 extending through bores 135 and 142. Bracket 132, bracket 134 and link 137 reside in an elevated location spaced above pedestal 49, as particularly seen with momentary reference to FIG. 7.

Hydraulic cylinder assembly 52, including cylinder 145 and operating rod 147, is connected at respective ends to boom 33 and to second gripping member 43. Bifurcated mounting bracket 148 having bore 149 therethrough extends rearwardly from inner end 98 of inner arm 43. In accordance with conventional practice, free end 150 of cylinder 145 is received within mounting bracket 90 and pivotally secured thereto by pin 152 extending through bore 92. Free end 153 of operating rod 147 is pivotally secured within bracket 148 by pin 154.

Hydraulic cylinder assembly 52 is of the double acting type whereby operating rod 147 can be driven in reciprocal directions, as indicated by the double arrowed line L, in response to selective directional application of pressurized hydraulic fluid as will be readily appreciated by those skilled in the art. Bracket 132 functions as a bell crank between pin 97 and pin 143, the axes of rotation of first gripping member 42 and first end 138 of link 137, respectively. Similarly, bracket 134 functions as a bell crank between pin 102 and pin 144. Link 137 extends diagonally forward from pin 144 to pin 143. Accordingly, for movement between the retracted position seen in FIG. 2 and the extended position seen in FIG. 3, hydraulic cylinder assembly 52 is selectively supplied with pressurized hydraulic fluid to extend operating rod 147 in the direction indicated by the arrowed line M in FIG. 6. In response, inner arm 47 of second gripping member 43 rotates inwardly about pin 102 as indicated by the arcuate arrowed line N and drawing link 137 rearwardly as indicated by the arrowed line O. As link 137 moves in the direction of arrowed line O, pin 143 moves rearwardly causing inward rotational movement of inner arm 44 of first gripping member 42 about pin 97 as indicated by the arcuate arrowed line P. For movement from the extended position to the retracted position, hydraulic cylinder assembly 52 is selectively supplied with pressurized hydraulic fluid to retract operating rod 147 resulting in a reversal of the above described movements.

Referring again to FIG. 4, it is seen that hydraulic cylinder assembly 54 of tensioning means 53 includes cylinder 155 having free end 157 and operating rod 158 having free end 159. Free end 157 of Cylinder 155 is pivotally carried within bracket 88 by pin 160 extending through free end 157 and residing within bore 89. Clevis 160 having bore 162 extending therethrough is carried at the free end 159 of operating rod 158. Operating rod 158 is telescopically disposed within cylinder 155 for reciprocation along a longitudinal axis as represented by the double arrowed line Q. A conventional commercially available apparatus, hydraulic cylinder assembly 54 is caused to operate in response to the previously noted source of pressurized hydraulic fluid.

Figure 7:
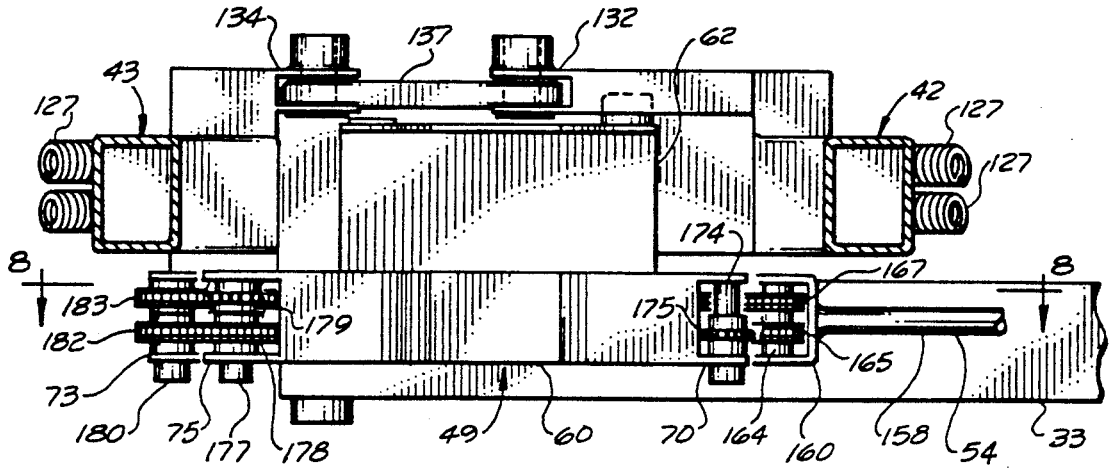
FIG. 7 is a vertical sectional view taken along the line 7—7 of FIG. 6.

Shaft 164, as further illustrated in FIG. 7, is carried within bore 162 of clevis 160 and rotatably supports first and second tandemly arranged sprockets 165 and 167, respectively. Similarly, shaft 168 carried in bore 169 of bifurcated bracket 170 supports tandemly arranged third and fourth sprockets 172 and 173, respectively. For alignment purposes with clevis 160, bracket 170 resides on the under side of inner arm 47 and preferably extends forwardly from the inner end 98 thereof.

Several additional sprockets are rotatably mounted upon the foundation portion 60 of pedestal 49 in alignment with respective ones of the previously described sprockets. With reference to FIGS. 4 and 7, it is seen that shaft 174 rotatably supporting fifth sprocket 175 is carried in bore 72 of bracket 70. Shaft 177 rotatably supporting tandemly arranged sixth sprocket 178 and seventh sprocket 179, is secured within bore 77 of bracket 75. Similarly, shaft 180 is carried within bore 73 of bracket 74 and rotatably supports eighth sprocket and ninth sprocket 182 and 183, respectively. The several sprockets are arranged in two aligned groups. First sprocket 165, third sprocket 172, fifth sprocket 175, sixth sprocket 178 and eighth sprocket 182 comprise a first plurality of aligned sprockets which generally lie in a plane which is substantially perpendicular to the axes of rotation of first gripping member 42 and second gripping member 43. Second sprocket 167, fourth sprocket 173, seventh sprocket 179 and ninth sprocket 183 similarly comprise a second plurality of aligned sprockets generally residing in another plane at an elevation spaced above and parallel to the first plurality of aligned sprockets.

Tensioning means 53, as preferably seen with reference to FIG. 4, further includes first chain 184 having inner end 185 and outer end 187 and second chain 188 having inner and outer ends 189 and 190, respectively. Attachment member 192 secures the outer end 187 of first chain 184 to outer arm 45 of first gripping member 42 at a location spaced from outer end 103. Although not specifically illustrated, outer end 190 of second chain 188 is similarly affixed to outer arm 48 of second gripping member 43. Intermediate the ends, first chain 184 extends about and is engaged with each of the first plurality of aligned sprockets. More specifically, first chain 184, in a direction from outer end 187, passes behind sprocket 175 and is angularly redirected to a forward engagement with eighth sprocket 180. Subsequently, chain 184 is again angularly redirected to reverse direction about third sprocket 172 to be received by the forward portion of sixth sprocket 178. Finally, the direction of first chain 184 is reversed about first sprocket 165. Second chain 188 wends a similar circuitous course about each of the several sprockets comprising the second aligned plurality after first passing behind ninth sprocket 183.

Figure 8:
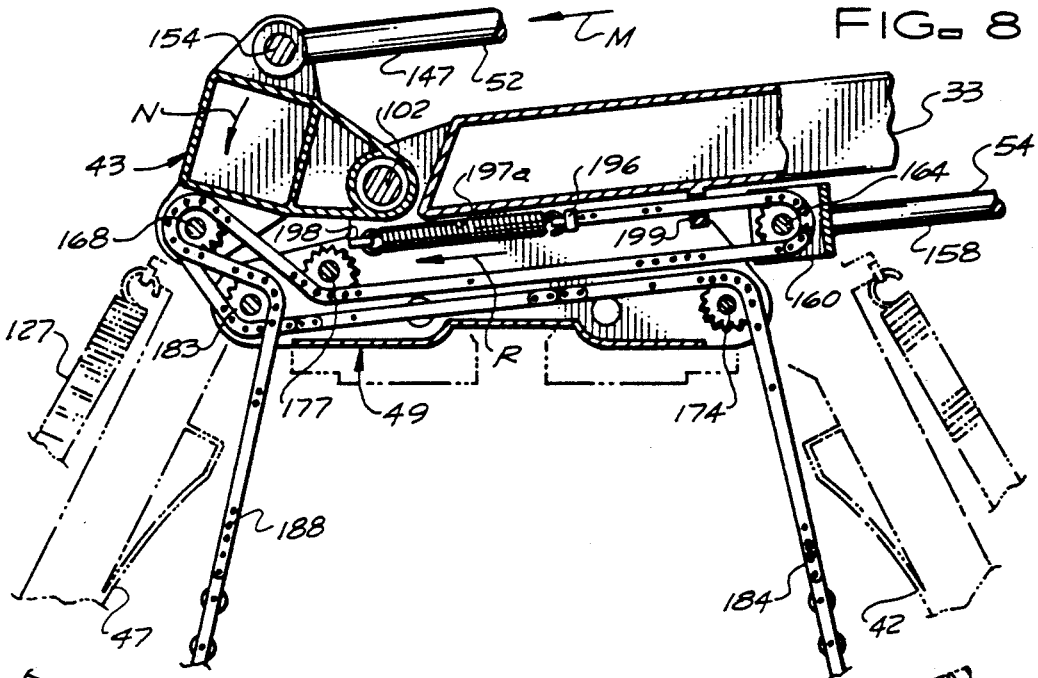
FIG. 8 is a horizontal sectional view taken along the line 8—8 of FIG. 7 and especially showing the gripping apparatus as it would appear in the extended position.
Figure 9:
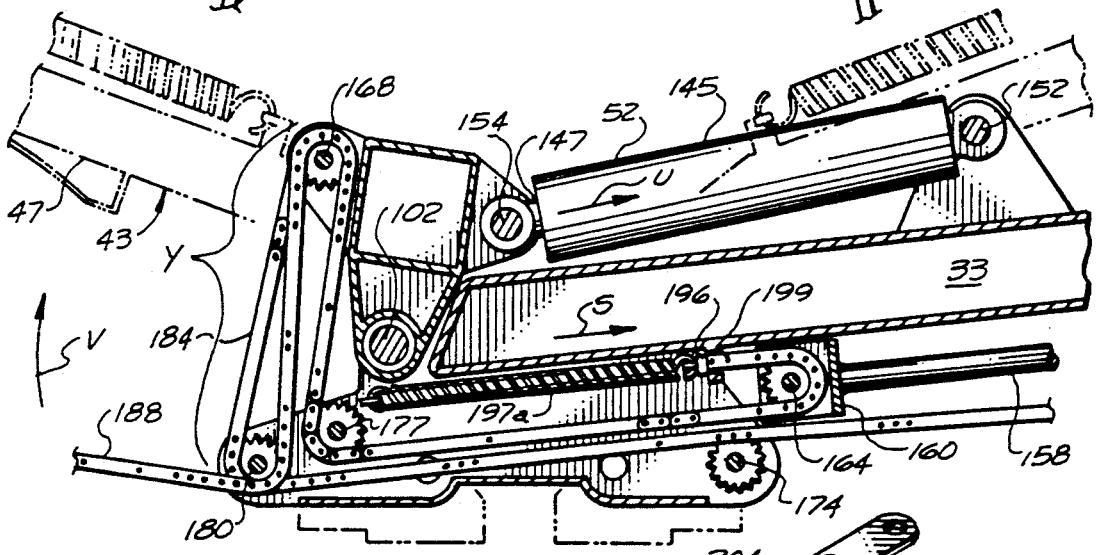
FIG. 9 is a view generally corresponding to the view of FIG. 8 and illustrating the gripping apparatus as it would appear in the retracted position.

First chain 184 concludes with a terminal portion 193 adjacent inner end 185 and extending beyond first sprocket 165. Second chain 188 includes a similar terminal portion 194 adjacent inner end 189 and substantially parallel to the terminal section 193. Block 195 is joined to inner end 185 of first chain 184. Similarly, block 196 is secured to the inner end 189 of second chain 188. Blocks 195 and 196 further function as attachments for one end of the compression springs 197 and 197A, respectively. Referring now to FIG. 8, it is seen that the other end of each compression spring is secured to lug 198 projecting from pedestal 49 to exert tension and normally draw the inner ends of each chain in the direction indicated by the arrowed line R. Although only spring 197A is seen in the immediate illustration, it should be readily appreciated that spring 197 is similarly secured and lies immediately below spring 197A. Similarly, block 195 resides immediately below block 196. Intermediate the ends 185 and 189 and sprockets 165 and 167, the terminal portions 193 and 194 of chains 184 and 188, respectively, pass through apertured stop member 199 projecting from boom 33. Stop member 199 serves as an abutment for receiving the blocks 195 and 196 thereagainst and limiting the extension of springs 197 and 197A in the direction of arrowed line S as seen in FIG. 9.

Figure 10:
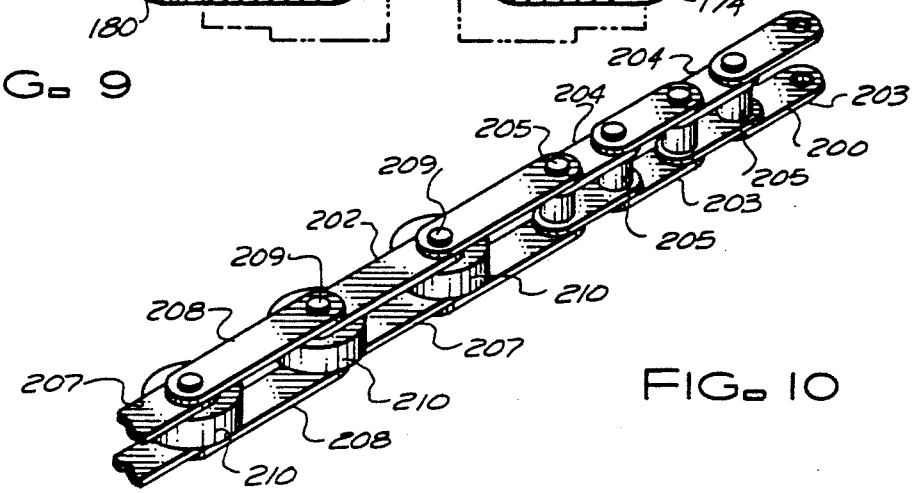
FIG. 10 is a fragmentary perspective view of an elongate flexible member useful in connection with the practice of the instant invention.

With reference to FIGS. 4 and 8, it is seen that first chain 184 and second chain 188 are similarly constructed, each having a first segment 200 extending from the respective inner end and a second segment 202 extending from the respective outer end. Each inner segment 200 as seen in detail in FIG. 10, conventionally includes outer and inner links 203 and 204, respectively, joined by roller pins 205 to engage and function in cooperation with the several previously described sprockets. Outer segment 202 comprises a plurality of overlapping inner and outer links 207 and 208, respectively, joined by pins 209. A cylindrical button 210 is rotatably carried by each pin 209 intermediate opposing links. Each button 210 has a diameter which is greater than the width of each link 207 and 208. The several buttons 210, which may be fabricated of a material having a low coefficient of friction, functions as grip enhancing means unabrasively moving and bearing. It is within the scope of the instant invention that each second segment 200 and 202 may be fabricated of cable, belting or other flexible material. Further description of tensioning means 53 will be made presently.

Referring again to FIGS. 4 and 6, it is seen that pads 55 and 57 are mirror images in structure and in operation. Pad 55 includes rigid backing plate 212 having a front surface 213 and rear surface 214. Facing 215, preferably a sheet of resilient material, is bonded to front surface 213 of backing plate 212. Hinge block 217 projecting from rear surface 214 is sized to be received within bifurcated bracket 78. Pintle 218 extending through hinge block 217 and within bore 79 hingedly affixes pad 55 to pedestal 49. Pad 57 similarly includes backing plate 219 having front surface 220 and rear surface 222. Facing 223 is carried on front surface 220. Hinge block 224 projecting from rear surface 222 is received within bracket 80 and pivotally secured thereto by pintle 225 carried in bore 82.

Pads 55 and 57 are rotatable, as defined by the respective pintles, about axes which are substantially parallel to the axes of rotation of the gripping members 42 and 43. Spacer 67 of pedestal 49 functions as a stop for receiving the rear surface 214 of backing plate 212 and the rear surface 222 of backing plate 219 thereagainst to limit outboard divergent rotation of the pads 55 and 57 to a substantially aligned position with the front surfaces of the respective backing plates substantially lying in a single plane. Concave midsection 227 of spacer 67 receives the inboard edges of plates 55 and 57 during convergent inboard rotation as represented by the arcuate lines T.

Figure 11:
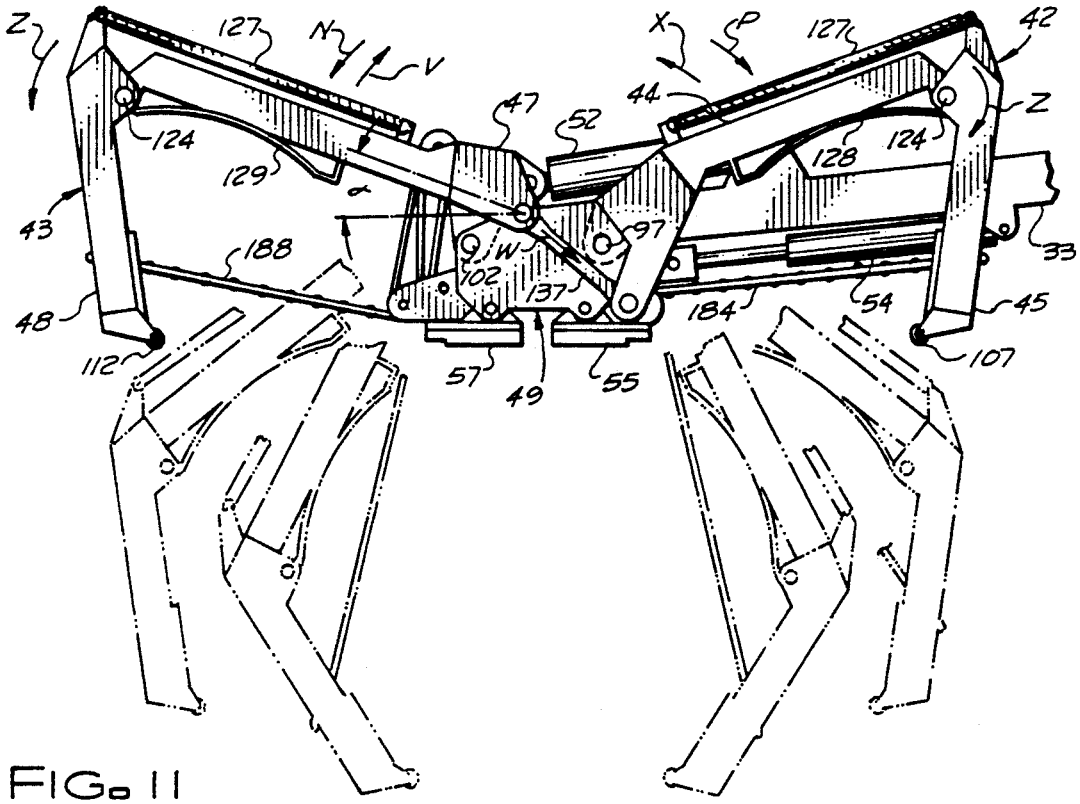
FIG. 11 is a top plan view generally corresponding to the illustration of FIG. 2 and further illustrating, in fragmentary broken outline, sequential movement of the gripping apparatus to the extended position.

Turning now to FIG. 11, the gripping apparatus of the instant invention is illustrated in solid outline as it would appear in the retracted position which is normal for stowage during travel of refuse collection vehicle 20. The device is urged into the retracted position in response to retraction of hydraulic cylinder assembly 52. That is, hydraulic cylinder assembly 52 is selectively and controllably supplied with pressurized hydraulic fluid to telescopingly move operating rod 147 within cylinder 145 in the direction indicated by the arrowed line U in FIG. 9. Drawn by pin 154 which is movable with operating rod 147, inner arm 47 of second gripping member 43 rotates about pin 102 in the direction indicated by the arcuate arrowed line V. With cylinder 52 in the fully retracted position, inner arm 47 resides at a location which is rearwardly inboard with reference to vehicle 20 as represented by the angle alpha. Concurrently, link 137 pushed by pin 144 to move in a direction indicated by the arrowed line W bears against pin 143 causing inner arm 44 of first gripping member 42 to rotate about pin 97 in the direction indicated by the arrowed arcuate line X. At the terminus of movement to the fully retracted position, inner arm 44 extends forwardly inboard to rest at a position which is a substantial mirror image of the position of inner arm 47.

Chains 184 and 188 are of finite length. With inner arm 47 in the retracted position, pin 168, carrying sprockets 172 and 173, resides at a location which is substantially spaced from shaft 177 carrying sprockets 178 and 179 and from shaft 180 carrying sprockets 182 and 183. The relative spacing of the respective sprockets creates a doubled length of the chains within the space represented by the bracket designated Y in FIG. 9. The effectively shortened chains exert tension upon the respective outer arms. More specifically, chain 188 causes rotational movement of arm 48 about pin 121 in a direction as indicated by the arcuate arrowed line Z against the biasing of spring 127. Correspondingly, outer arm 45 is rotated about pin 121 as indicated by the arcuate line Z in response to chain 184. Ultimately, outer arms 45 and 48 extend convergently outboard in substantial mirror image.

The gripping apparatus is moved from the retracted position to the extended position in response to pressurized hydraulic fluid being selectively supplied to hydraulic cylinder assembly 52 whereby operating rod 147 is extended in the direction indicated by the arrowed line M in FIG. 8. The movement of operating rod 147 rotates inner arm 47 about pin 102 in a generally outboard direction as indicated by the arcuate arrowed line N. Concurrently, link 137 moves in the direction of arrowed line O causing inner arm 44 to rotate about pin 97 in the direction indicated by the arcuate arrowed line P for synchronous movement with inner arm 47.

As inner arm 47 rotates in the extending direction, pin 168 continuously moves closer to pins 177 and 180 thereby progressively decreasing the length of the double chain and simultaneously, progressively increasing the effective overall length of chains 184 and 188. Springs 127, functioning in synchronous opposition with the chains 184 and 188, rotate the outer arms 45 and 48 outwardly about the respective pins 121. Ultimately, the complemental abutment surface 123 carried by each outer arm contacts the abutment surface 118 of each respective inner arm to increase the angle therebetween as shown in broken outline in FIG. 11.

Figure 12:
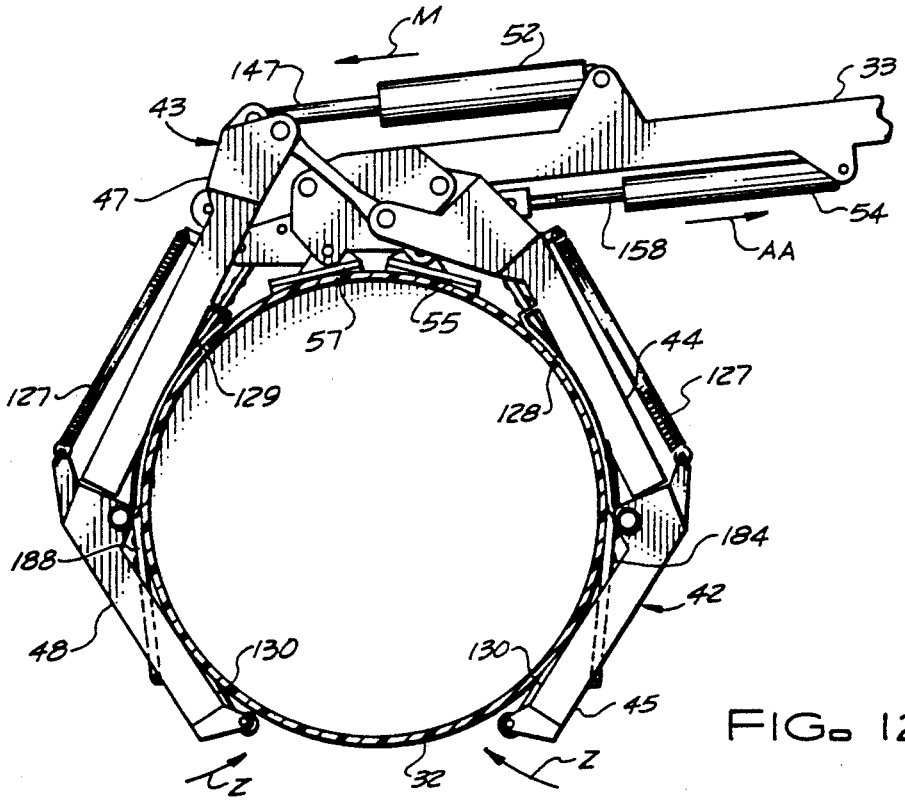
FIG. 12 is a view generally corresponding to the view of FIG. 11 and showing the gripping apparatus thereof as it would appear when engaged about a large cylindrical container, the container being shown in horizontal sectional view.

Movement between the retracted position and the extended position shown in solid outline and broken outline, respectively, in FIG. 11 proceeds until the gripping members 42 and 43 are engaged about container 32 as seen in FIG. 12. As a result of the spacing between axes C and F, the respective axes of rotation of inner arms 44 and 47, respectively, the gripping members exhibit a greater tendency to embrace than push the container. Chosen for exemplary purposes, container 32 is generally illustrative of the commercially available relatively large cylindrical type having a capacity of approximately 400 gallons and a diameter of approximately 41 inches. The initial contact of first gripping member 42 and of second gripping member 43 with container 32 may be relatively random. In other words, initial contact may be made by concave members 128 and 129, chains 184 and 188 or pads 130. Operating rod 147 of hydraulic cylinder assembly 52 continues to extend in the direction indicated by the arrowed line M until gripping members 42 and 43 exert a predetermined pressure upon container 32. For purposes of orientation and reference, this is generally considered the termination of the extension phase of operation.

Subsequently, hydraulic cylinder assembly 54 is actuated to urge operating rod 158 in the direction indicated by the arrowed line AA extending springs 197 and 197A and bringing the respective blocks 195 and 196 into engagement with stop member 199. Again, for purposes of orientation and reference, this is considered the initiation of the gripping phase of operation. As will be readily appreciated, the extension phase and the gripping phase may overlap or progress concurrently.

Continued movement of operating rod 158 simultaneously shortens the effective length of chain 184 and of chain 188. As the chains are effectively shortened, outer arm 45 and outer arm 48 are rotated inwardly as represented by the arcuate arrowed lines Z. As the movement of outer arms 45 and 48 continues, container 32 is urged inwardly by pads 130 to be firmly seated in concave panels 128 and 129 and against pads 55 and 57. Hydraulic cylinder assembly 5 continues to operate to a predetermined pressure at which time chains 184 and 188 also exert a gripping force upon container 32. The chains, being independently tensioned by the respective springs and simultaneously tensioned by hydraulic cylinder assembly 54, function correspondingly but independently to accommodate any irregularities in the load to be gripped as will be further appreciated from the description which follows. The container is now ready to be lifted and tilted for dumping.

In a conventional refuse collection vehicle, the onboard hydraulic system typically provides hydraulic fluid which is pressurized to within a range of two thousand pounds per square inch (PSI) to three thousand PSI. Hydraulic cylinder assembly 52, having a preferred nominal diameter of three inches, is capable of exerting more than twenty thousand pounds of force. Having a preferred diameter of two inches, hydraulic cylinder 54 assembly is capable of exerting a force of more than nine thousand pounds. In accordance with the immediately preferred embodiment of the instant invention, actuation of hydraulic cylinder assembly 54 is initiated when hydraulic cylinder assembly 52 has achieved a pressure of approximately one thousand two hundred PSI exerting and extending force of about eight thousand five hundred pounds.

Various means for sequentially performing the extension and gripping functions will readily occur to those skilled in the art. The supply of pressurized hydraulic fluid to hydraulic cylinder assembly 52 and the supply of pressurized hydraulic fluid to hydraulic cylinder assembly 54 may be under separate control for selective manipulation by the operator. It is preferred, however, that the hydraulic cylinder assemblies be interconnected by a sequence valve whereby the flow of pressurized fluid is first directed to hydraulic cylinder assembly 52 and subsequently to hydraulic cylinder assembly 54 when a predetermined pressure is attained.

Figure 13:
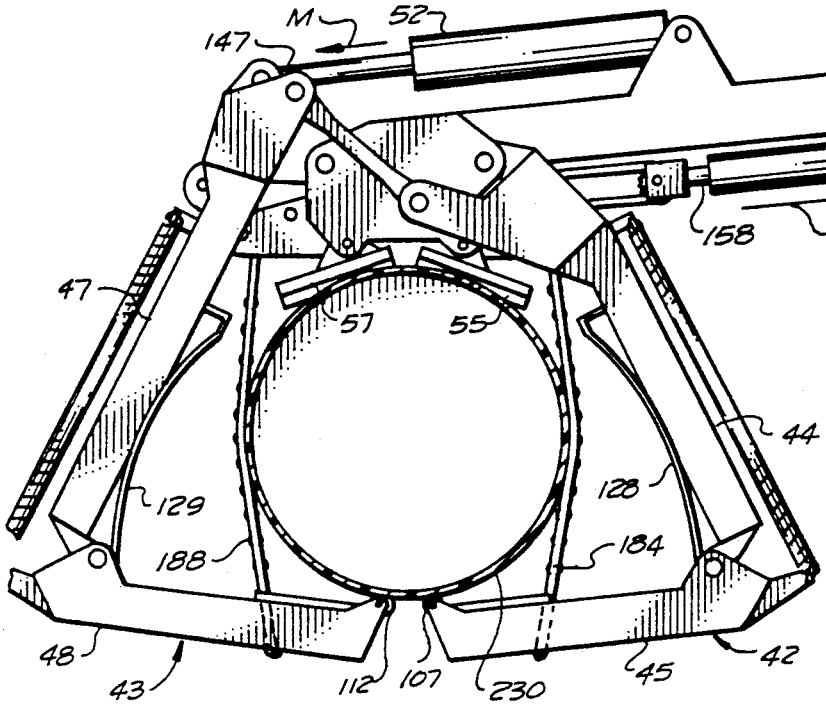
FIG. 13 is a view generally corresponding to the illustration of FIG. 12 and showing the gripping apparatus as it would appear when engaged about a small cylindrical container, the container being shown in horizontal sectional view.

Referring now to FIG. 13, there is illustrated a conventional prior art container 230 of the type usually referred to as "small, round", having a capacity of approximately fifty gallons and a diameter of approximately twenty-two inches. In gripping container 230, the gripping apparatus of the instant invention sequentially functions generally as previously described in connection with the gripping of container 32. At the limit of travel of operating rod 147, the attainment of the predetermined maximum pressure within hydraulic cylinder assembly 52, inner arms 44 and 47, more specifically concave plates 128 and 129, are spaced from container 230. In response to subsequent movement of operating rod 158 of hydraulic cylinder assembly 54 in the direction indicated by the double arrowed line AA, outer arms 45 and 48 are rotated inwardly bringing rollers 107 and 112 into contact with container 230, drawing container 230 into contact with pads 54 and 57. Activation of hydraulic cylinder assembly 54 is continued until attainment of the predetermined maximum pressure at which time container 230 is firmly gripped between rollers 107 and 112 and pads 55 and 57 and between chains 184 and 188. Buttons 210 enhance the grip of chains 184 and 188, and retard marring or damage of container 230 by links 207 and 208.

Figure 14:
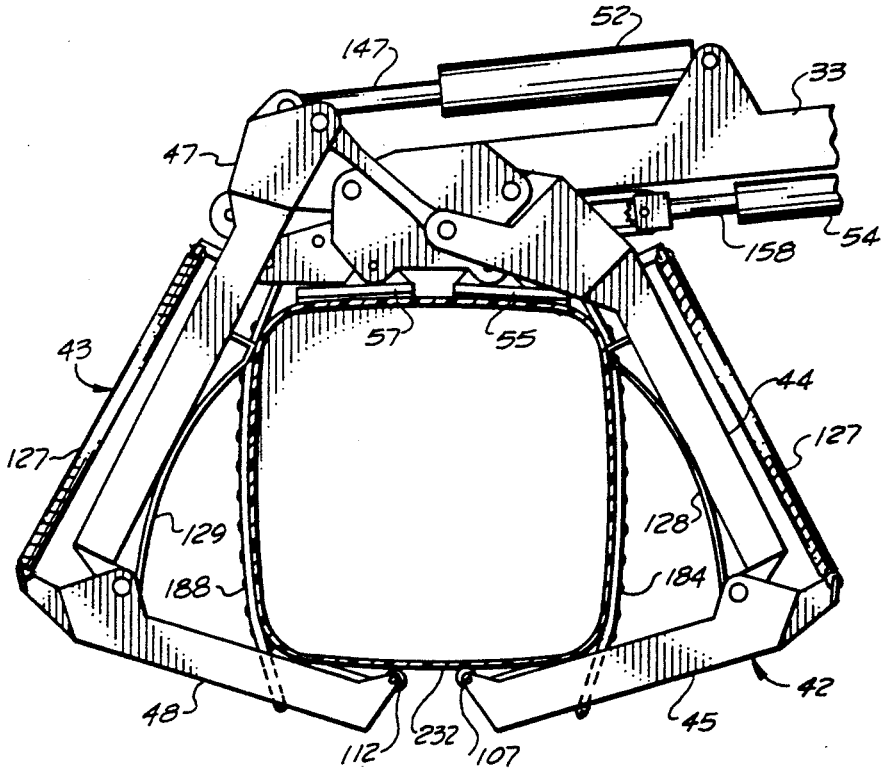
FIG. 14 is another view generally corresponding to the view of FIG. 12 and especially illustrating the gripping apparatus as it would appear when engaged about a rectangular container.

Illustrated in FIG. 14 is another prior art container designated by the reference character 232. Being generally square, container 232 has a nominal capacity of approximately ninety gallons and a transverse measurement of approximately twenty-six inches. The sequential operation of the gripping apparatus of the instant invention during engagement with container 232 is analogous to the operation of gripping container 230 as set forth in connection with the description of FIG. 13.

Figure 15:
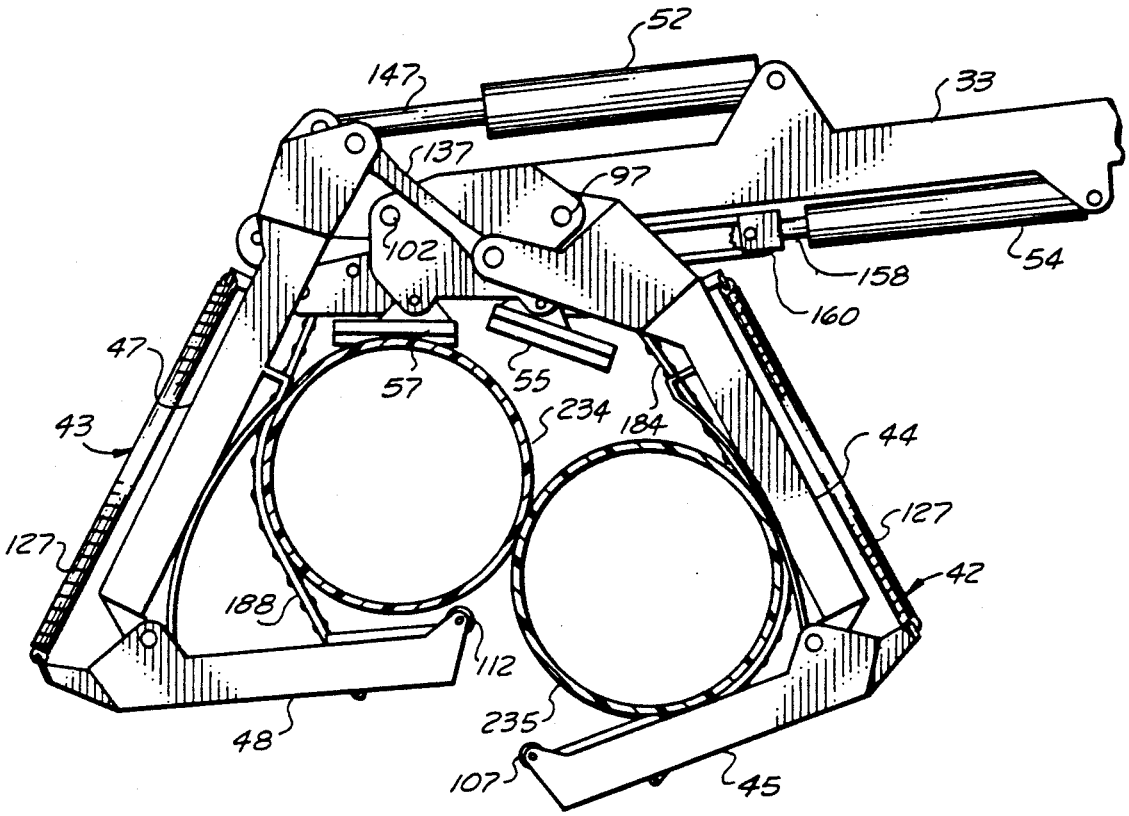
FIG. 15 is still another view generally corresponding to the view of FIG. 12 and especially illustrating the gripping apparatus as it would appear when engaged about a pair of small containers.

Being omnifarious, the gripping apparatus of the instant invention is capable of simultaneously gripping and holding more than one container. Turning now to FIG. 15, there is seen a possible configuration this apparatus may assume when concurrently engaging two containers, herein shown as small round containers 234 and 235. Although the containers abut, each is primarily engaged by a respective arm of the gripping members, which function cooperatively, yet independently, as a result of the individual tensioning of the respective chains.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, what is claimed is:

1. A gripping apparatus for use in combination with a refuse collection vehicle having a lifting member and for alternately engaging and holding at least a first container and a second container of differing parametric configurations, said gripping apparatus comprising:

a) a first segmented gripping member including
  i) an inner arm movably affixed to said lifting member, and
  ii) an outer arm having an inner end and an outer end, movably extending from said inner arm;

b) a second segmented gripping member including
  i) an inner arm movably affixed to said lifting member, and
  ii) an outer arm having an inner end and an outer end, movably extending from said inner arm;

c) actuating means carried by said lifting member for moving said first and said second gripping members between
  i) a retracted position in which said inner arms extend in substantially opposed directions, and
  ii) an extended position in which said inner arms extend in substantially the same direction; and d) tensioning means coupled to each of said outer arms intermediate said inner end and said outer end for moving said outer arm of said first segmented gripping member and said second segmented gripping member inwardly relative to said inner arm of said first segmented gripping member and said second segmented gripping member, respectively.

* * * * *